United States Patent [19]

Dyer

[11] Patent Number: 5,020,157

[45] Date of Patent: Jun. 4, 1991

[54] BALLISTIC PROTECTIVE INSERT FOR USE WITH SOFT BODY ARMOR BY FEMALE PERSONNEL

[75] Inventor: Peter A. Dyer, Huber Heights, Ohio

[73] Assignee: The United States of America as represented by the Secretary of the Air Force, Washington, D.C.

[21] Appl. No.: 487,316

[22] Filed: Mar. 2, 1990

[51] Int. Cl.[5] ..... F41H 1/02

[52] U.S. Cl. ..... 2/2.5; 2/267; 2/92

[58] Field of Search ..... 2/2, 2.5, 44, 90, 92, 2/267, 268, 115, 106; 450/1, 37, 39, 40, 54, 55, 56

[56] References Cited

U.S. PATENT DOCUMENTS

| | | | |
|---|---|---|---|
| 163,448 | 5/1875 | Bracher | 2/267 |
| 181,261 | 8/1876 | Hayward | 2/267 |
| 204,460 | 6/1878 | Tallman | 2/267 |
| 1,018,066 | 2/1912 | Mayer et al. | 2/267 |
| 1,721,739 | 7/1929 | Kennedy | 2/2 |
| 2,445,767 | 7/1948 | Dickerson | 450/39 |
| 2,454,535 | 6/1947 | Warner | 2/267 |
| 2,466,597 | 4/1949 | Kropscott et al. | 2/2.5 X |
| 2,468,841 | 5/1949 | Siegal | 280/2 |
| 2,495,307 | 1/1950 | Abramson | 128/282 |
| 2,579,365 | 12/1951 | Condé | 2/267 |
| 2,611,898 | 9/1952 | Laird | 450/39 |
| 2,891,544 | 6/1959 | London | 2/267 |
| 3,176,686 | 4/1965 | Barnes | 450/34 X |
| 3,478,739 | 11/1969 | Librande | 2/2 X R |
| 3,519,529 | 7/1970 | Cook | 2/2.5 X |
| 3,562,810 | 2/1971 | Davis | 2/2.5 |
| 3,832,265 | 8/1974 | Denommee | 2/2.5 |
| 4,183,097 | 1/1980 | Mellian | 2/2.5 |
| 4,483,020 | 11/1984 | Dunn | 2/2.5 |
| 4,530,111 | 7/1985 | Barron et al. | 2/2.5 |
| 4,566,458 | 1/1986 | Weinberg | 450/54 |
| 4,578,821 | 4/1986 | Zufle | 2/2.5 |
| 4,607,640 | 8/1986 | McCusker | 450/1 |
| 4,732,803 | 3/1988 | Smith, Jr. | 2/2.5 X |
| 4,737,401 | 4/1988 | Harnell et al. | 2/2.5 X |
| 4,774,724 | 10/1988 | Sacks | 2/2.5 |
| 4,854,915 | 8/1989 | Luedy | 450/54 X |

FOREIGN PATENT DOCUMENTS

| | | | |
|---|---|---|---|
| 0516415 | 9/1955 | Canada | 450/39 |
| 1082585 | 7/1980 | Canada | 2/2.5 |
| 0197278 | 10/1986 | European Pat. Off. | 2/2.5 |
| 0199019 | 10/1986 | European Pat. Off. | 2/2.5 |
| 0787498 | 9/1935 | France | 450/39 |
| 0969259 | 12/1950 | France | 450/39 |
| 8403529 | 6/1986 | Netherlands | 2/2.5 |
| 1556245 | 11/1979 | United Kingdom | 2/2.5 |

*Primary Examiner*—Werner H. Schroeder
*Assistant Examiner*—Jeanette E. Chapman
*Attorney, Agent, or Firm*—Fredric L. Sinder; Donald J. Singer

[57] ABSTRACT

A ballistic protective insert for use with soft body armor by female personnel is disclosed. The ballistic protective insert provides enhanced protection to female breast tissue which is uniquely susceptible to the harmful effects of blunt trauma from ballistic impact. The ballistic protective insert is a rigid, inflexible cup worn over a woman's breast and under a conventional soft body armor vest. The insert is preferably made of SPECTRA SHIELD, a high strength polyethylene material, sheets laminated together with epoxy. The protective insert appears to work by a combination of dynamic effects. The dynamic effects include redirecting ballistic impact forces to the muscular chest wall surrounding the breasts, and creating a compression wave inside the breast which reflects off the chest wall as a tension wave and then tends to push the insert away from the breast. The protective inserts resist any significant deformation for as long as possible to reduce impact intensity. The protective inserts also increase the snugness of the fit of conventional soft body armor which maximizes the energy absorption ability of the ballistic fabric from which soft body armor is made.

2 Claims, 2 Drawing Sheets

BALLISTIC PROTECTIVE INSERT FOR USE WITH SOFT BODY ARMOR BY FEMALE PERSONNEL

RIGHTS OF THE GOVERNMENT

The invention described herein may be manufactured and used by or for the Government of the United States for all governmental purposes without the payment of any royalty.

BACKGROUND OF THE INVENTION

The present invention relates generally to soft body armor, and more specifically to a novel ballistic protective insert for providing enhanced protection for female breasts.

Soft body armor is often worn by law enforcement personnel to protect against the ballistic impact of projectiles such as bullets. Soft body armor is generally made with flexible ballistic fabric woven from ballistic fibers such as KEVLAR, an aramid polymer fiber made by DuPont Corporation, or SPECTRA, a high strength/high modulus polyethylene fiber made by Allied Signal, Inc. While soft body armor can save the life of an law enforcement officer by preventing bullet penetration, the impact energy transferred to the officer's body will cause painful injury, called blunt trauma, most often in the form of severe bruises and even broken bones. The dangers from ballistic impact are particularly acute in the case of blunt trauma to female breasts. Breast, or mammary, tissue is easily bruised and heals slowly. Injury often results in necrosis, or death, of the mammary tissue with lumpy scar tissue eventually replacing the dead tissue. Beyond possible disfigurement, breast injuries from blunt trauma can result in loss of a breast and even death from internal bleeding.

The soft body armor prior art has recognized and attempted to solve some of the ballistic impact protection problems unique to women, particularly the problem of fit. For example, U.S. Pat. No. 4,578,821 to Zufle discloses a ballistic fabric body armor front insert panel that can be easily adjusted into a horizontal ridge-like shape to accommodate the contour of a woman's bust. U.S. Pat. No. 4,183,097 to Mellian discloses a body armor vest garment specially made for use by women. The Mellian patent shows a ballistic fabric protective front panel made from two side panels partially overlapping a central panel to provide a shape contoured to the curvature of a woman's bust. The contour shape taught by the Mellian patent also provides a better fit, and therefore better protection, around the arm openings. Most manufacturers of soft body armor also offer steel and/or ceramic flat plates, including smaller sizes for women, that fit inside front pockets of the soft body armor over the wearer's chest to provide additional protection. These plates are generally rectangular and often incorporate a slight horizontal bend for fit.

The prior art also includes attempts to solve problems of breast injuries to women participating in athletics. For example, U.S. Pat. No. 3,478,739 to Librande and U.S. Pat. No. 3,176,686 to Barnes both disclose protective brassieres made of hard, but resilient or elastic, material to absorb the energy of impact.

Unfortunately, the attempted solutions of the prior art have not been completely successful. For example, contoured front panels appear to increase the risk of injury from ballistic impact over the sternum. There is approximately two inches of open space over the sternum, created by the contour shape of the panel, that must be collapsed before the soft body armor fabric can begin to stretch and dissipate the energy of an impacting projectile. Also, the addition of front plates appears to create a danger that impacting projectiles will be deflected toward the throat and head.

Moreover, the prior art has either, in the case of soft body armor adapted for use by women, not addressed the unique problem of greater sensitivity of mammary tissue to blunt trauma or, in the case of athletic protectors, only had to protect against relatively low impact forces where the expected energies could be nearly completely absorbed by tolerable levels of deformation and force.

It is thus seen that there is a need for a structure to be used with soft body armor that protects a female breast from the effects of blunt trauma caused by the ballistic impact of a projectile.

It is, therefore, a principal object of the present invention to provide a ballistic protective insert for use with soft body armor that protects a female breast from the effects of blunt trauma caused by ballistic impact.

It is another object of the present invention to provide a means for transferring the impact energy from a ballistic projectile striking a female breast to the chest wall or other, more injury-resistant, part of the body.

It is a further object of the present invention to provide a means for dissipating the impact energy from a ballistic projectile striking a female breast.

It is a feature of the present invention that it also increases the desirable snug fit of the ballistic fabric over a woman's bust to maximize the energy absorption ability of the ballistic fabric.

It is an advantage of the present invention that its combination of conventionally constructed soft body armor and a protective insert provides equal or greater protection against penetration of a ballistic projectile at a lighter overall weight than conventionally constructed soft body armor alone.

These and other objects, features and advantages of the present invention will become apparent as the description of certain representative embodiments proceeds.

SUMMARY OF THE INVENTION

The present invention provides a means for preventing most of the ballistic impact energy from a projectile striking a female breast from causing blunt trauma to the breast tissue. The unique discovery of the present invention is that a pair of rigid, molded forms, or cups, worn over each breast beneath the regular soft body armor will, through a combination of dynamic effects, reduce both the deformation of and the forces against the female breasts from ballistic impact and thereby reduce blunt trauma. Much of the ballistic energy is redirected to the muscular chest wall and skeleton. Some of the ballistic energy appears to pass through the breast tissue as a less harmful compression wave and then reflects from the chest wall as a tension wave which dissipates its energy in pushing the cups away from the breast tissue and in stretching outward the soft body armor fabric. The stretching outward of the soft body armor fabric, from the tension wave-produced outward push of the cups, and from the inherent rigidity of the cups, maximizes the energy absorption ability of the ballistic fabric from which the soft body armor is made.

Accordingly, the present invention is directed to a body armor garment for wear by a woman, comprising a front portion made of ballistic fabric shaped for wear over the woman's bust area and a pair of rigid, inelastic, cups, wherein each cup is shaped to conformably fit over a breast of the woman and under the front portion of the body armor garment. The rigid cups may be made of polyethylene fiber sheets laminated together by epoxy.

The invention is also directed to a body armor garment for wear by a woman, comprising a front portion made of ballistic fabric shaped for wear over the woman's bust area and means for redirecting ballistic impact energy applied to the bust area away from the woman's breasts. The impact energy redirecting means may direct energy to the chest wall surrounding the woman's breasts. The energy redirecting means may also comprise a pair of rigid cups, each cup shaped to conformably fit over a breast of the woman and under the front portion of the body armor garment.

The invention is further directed to a body armor garment for wear by a woman, comprising a front portion made of ballistic fabric shaped for wear over the woman's bust area and means for dissipating ballistic impact energy applied to the bust area by causing development of acoustic waves inside at least one of the woman's breasts. The means for dissipating ballistic impact energy may comprise a pair of rigid cups, each cup shaped to conformably fit over a breast of the woman and under the front portion of the body armor garment.

The invention is yet further directed to a body armor garment for wear by a woman, comprising a front portion made of ballistic fabric shaped for wear over the woman's bust area and means for, under ballistic impact, delaying for as long as possible initiation of significant deformation of the front portion.

The invention is still further directed to a method for protecting a woman's breast from the harmful effects of ballistic impact forces, comprising the step of redirecting the impact forces away from the breast toward the surrounding chest wall.

The invention is additionally directed to a method for protecting a woman's breast from the harmful effects of ballistic impact forces, comprising the step of covering the breast with a rigid shell to substantially convert the forces into a compression wave inside the breast.

DESCRIPTION OF THE DRAWINGS

The present invention will be more clearly understood from a reading of the following detailed description in conjunction with the accompanying drawings wherein.

DETAILED DESCRIPTION

Figure 1:
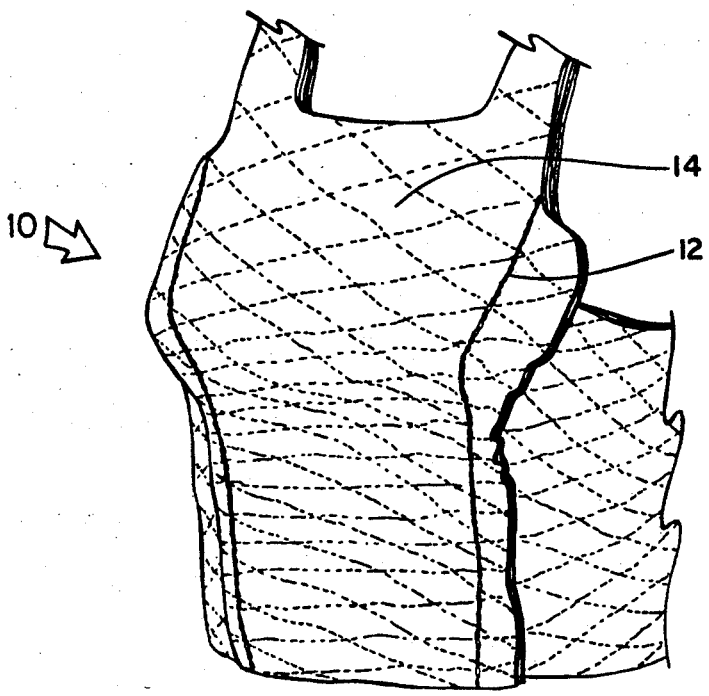
Fig. 1 PRIOR ART
FIG. 1 is a perspective view of the front portion of an example prior art soft body armor vest for a woman showing the contour construction of the vest to conform to the shape of the woman's bust.

Referring now to FIG. 1 of the drawings, there is shown a perspective view of an example prior art soft body armor vest 10 for a woman showing the contour construction of vest 10 to conform to the shape of the woman's bust. The contour shape is made through the use of tapered seams, or darts, 12 to make a darted front panel 14. Vest 10 is made of SPECTRA fabric, a new ballistic fabric available from Allied-Signal, Inc. in Petersburg, Virginia. SPECTRA fabric is woven from SPECTRA fibers which are very strong extended chain polyethylene fibers. Vest 10 can also be made of SPECTRA SHIELD, made from SPECTRA fibers held together by a polymeric resin.

Figure 2:
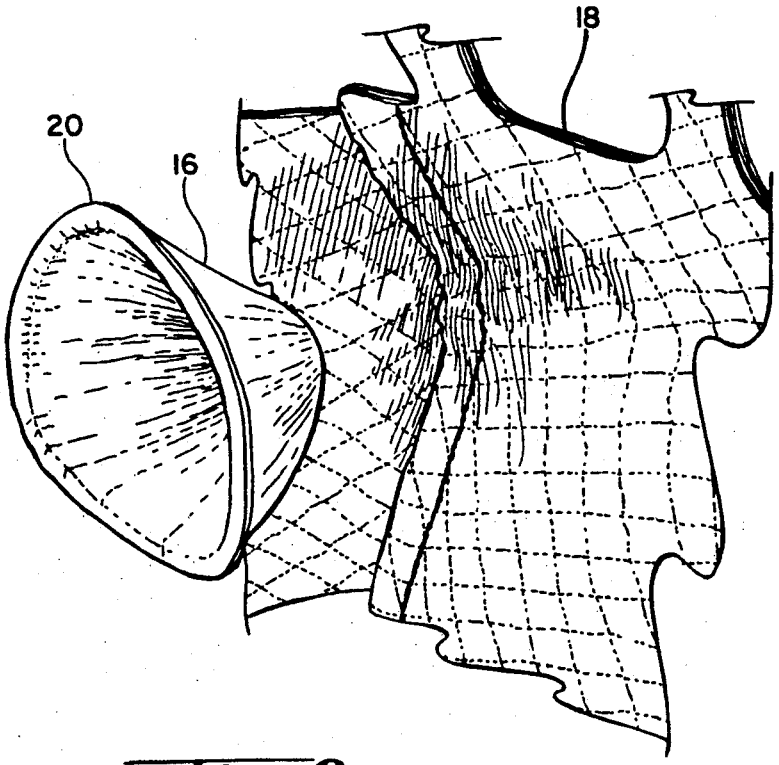
FIG. 2 is a perspective view of a ballistic protective insert according to the teachings of the Present invention showing its placement relative to a typical soft body armor vest.

FIG. 2 is a perspective view of a single ballistic protective insert 16 showing a preferred manner of wearing over a woman's breast and under a soft body armor vest 18. Insert 16 is preferably made of a very stiff or rigid material so that it resists as much as possible deformation from ballistic impact. Because a typical prior art elastic-resilient protective breast cup will deform completely under the high forces of ballistic impact, so that no real protection is obtained, making insert 16 as stiff as possible helps redirect the forces along the outer surface of insert 16 to flared bottom edges 20 where the forces can be transferred to the muscular chest wall and skeleton.

Protective insert 16 was made by laminating layers of SPECTRA SHIELD sheets with an epoxy to make as rigid, or stiff, a structure as possible. Protective inserts have been made with 18, 22 and 40 layers. The layers may be laminated so that the fibers are aligned in different directions from layer to layer.

Protective insert 16 preferably is worn underneath a conventional brassiere and fitted with a removable, washable, polypropylene cover for comfort. Wearing the protective insert beneath soft body armor increases the snugness of the soft body armor fit so that the ballistic fabric, and individual fibers, are able to effectively stretch to absorb ballistic impact energy.

Figure 3A:
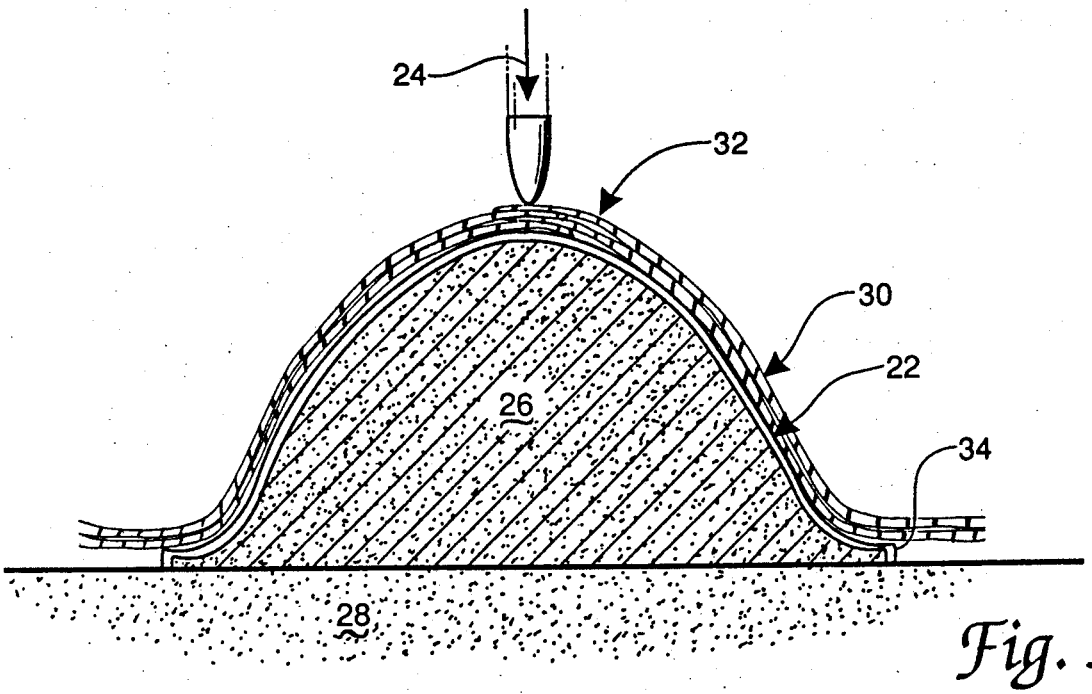
FIG. 3*a* and 3*b* are cross-sectional views of a ballistic protective insert before and after undergoing an impact test from a test-fired projectile.
Figure 3B:
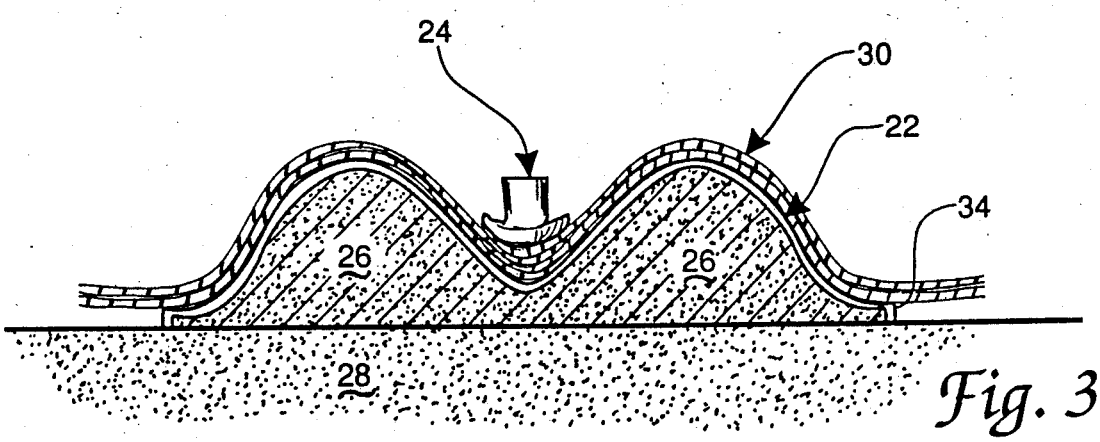

FIGS. 3*a* and 3*b* are cross-sectional views of a ballistic protective insert 22 before and after undergoing an impact test from a test-fired projectile, or bullet, 24. The impact test, one of many, was performed by placing protective insert 22 over a mound of fill clay 26, to simulate a breast, which in turn was placed on top of backing, or backface, clay 28 to simulate a muscled chest wall. A section of a soft body armor vest 30 was placed on top of fill clay mound 26. Vest 30 was sewn so that seam 32 lay directly over insert 22. Bullet 24 was a .357 mag bullet and was fired to strike vest 30 directly over the top of the highest point of protective insert 22. National Institute of Justice (NIJ) standard 0101.03 for Level IIA protection (.357 mag bullet (.158 gr.) fired at 381 m/sec (1250 ft/sec)) permits displacement of not more than 44mm (1.73 inches) into backface clay 28.

The impact tests demonstrated that the combination of soft body armor vest 30 and protective insert 22 provided increased protection over that provided by a soft body armor vest alone, in that projectile penetration into back clay 28, which occurred with a vest alone, was prevented with protective inserts ranging from 22 layers of SPECTRA SHIELD up to 40 layers. The tests showed that a SPECTRA SHIELD-protective insert combination can be made lighter in weight than a conventional KEVLAR vest capable of providing equal backface penetration resistance.

The tests did reveal the difficulty in making a completely rigid insert that can completely prevent deformation. However, the deformation that did occur was much less than would have occurred with soft body armor alone. The nature of blunt trauma to breast tissue is such that any reduction in impact forces and deformation is advantageous.

The tests also revealed that protective insert 22, rather than having its bottom edge 34 continuously forced against backing clay 28, instead rebounded from fill clay 26 so that, after the test was completed, some of fill clay 26 came to rest outside of protective insert 22 as shown in FIG. 3*b*. It is believed that this rebounding occurred when an initial compression wave, created by the impact of bullet 24 against the top of vest 30-protective insert 22, traveled through the fill clay-simulated breast tissue 26 and reflected as a tension wave from the interface of fill clay-simulated breast tissue 26 and backing clay-simulated chest wall 28, the fill clay-simulated breast tissue 26 having a lower acoustic impedance than the backing-clay-simulated chest wall 28. The reflected tension wave then pushed protective insert 22 outward from the breast. While the net overall effect, whether harmful or insignificant, of the compression and tension waves passing through the breast tissue is not known, it is believed that the creation of such acoustic waves by the presence of protective insert 22 at the very least both spreads out in time and helps reduce through dissipation the amplitude of the impact forces.

The tests also indicated a possibility that some of the rebounding and fill clay movement may be due to air compression underneath the protective insert during deformation.

The disclosed ballistic protective insert successfully demonstrates enhanced protection for female breasts against blunt trauma. Although the disclosed method is specialized, its teachings will find application in other areas where the unique characteristics of an entity (such as a woman's body) makes mere shape modification of apparatus (such as protective clothing) for use by the entity insufficient to provide the intended benefits of that apparatus to the entity.

It will be seen by those with skill in the field of the invention that other materials than SPECTRA SHIELD may advantageously be used to provide the desired rigidity or stiffness for a ballistic protective insert. The primary advantage of SPECTRA SHIELD is its high strength to weight ratio, which reduces the overall weight of a vest-protective insert combination. A likely characteristic of suitable other stiff materials is that deformation will not be linear by elastic deformation, but sudden through inelastic buckling or similar failure. The object is to prevent deformation as much, and failing complete prevention, for as long as possible so that the total impacting ballistic energy, when deformation finally occurs, has been spent or dissipated as much as possible through redirection, reflection or other dynamic effects. Other modifications to the invention as described may be made, as might occur to one with skill in the field of the invention, within the intended scope of the claims. Therefore, all embodiments contemplated have not been shown in complete detail. Other embodiments may be developed without departing from the spirit of the invention or from the scope of the claims.

I claim:

1. A body armor garment for wear by a woman wearing a conventional soft brassiere having a pair of soft cups, comprising:

(a) a front portion made of ballistic fabric shaped for wear over the woman's bust area and the brassiere; and, (b) a pair of rigid, inelastic, cups, wherein each rigid cup is shaped to conformably fit over a breast of the woman and under a soft cup of the brassiere.

2. The body armor garment according to claim 1, wherein the rigid cups are made of polyethylene fiber sheets laminated together by epoxy.

* * * * *